US010222097B2

(12) United States Patent
Duval et al.

(10) Patent No.: US 10,222,097 B2
(45) Date of Patent: Mar. 5, 2019

(54) PASSIVE PHASE CHANGE COOLING DEVICE

(75) Inventors: Jean-Marc Duval, Quaix en Chartreuse (FR); Ivan Charles, Saint-Egreve (FR)

(73) Assignee: COMMISSARIAT À L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 735 days.

(21) Appl. No.: 13/640,207

(22) PCT Filed: Apr. 8, 2011

(86) PCT No.: PCT/FR2011/000205
§ 371 (c)(1),
(2), (4) Date: Oct. 9, 2012

(87) PCT Pub. No.: WO2011/124790
PCT Pub. Date: Oct. 13, 2011

(65) Prior Publication Data

US 2013/0025841 A1 Jan. 31, 2013

(30) Foreign Application Priority Data

Apr. 9, 2010 (FR) ..... 10 01493

(51) Int. Cl.
*F25B 9/14* (2006.01)

(52) U.S. Cl.
CPC ..... *F25B 9/145* (2013.01); *F25B 2309/1423* (2013.01); *F25B 2309/1424* (2013.01)

(58) Field of Classification Search
CPC ..... F25B 9/145; F25B 2309/1421; F25B 2309/1423; F25B 2309/1424; F25B 2309/1426; F25B 2309/1413; F25B 2309/1407; F25B 2309/1405
USPC ..... 62/6
See application file for complete search history.

(56) References Cited

U.S. PATENT DOCUMENTS 5,689,959 A 11/1997 Yatsuzuka et al.
5,791,149 A 8/1998 Dean
5,813,235 A * 9/1998 Peterson ..... F25B 9/14 60/518

(Continued)

FOREIGN PATENT DOCUMENTS

CN 2913968 * 6/2007
DE 10 2004 033 027 A1 2/2006

(Continued)

OTHER PUBLICATIONS

Qiu, CN2913968TRANS (English Translation), Jun. 2007.*

(Continued)

*Primary Examiner* — Eric Ruppert
(74) *Attorney, Agent, or Firm* — Oliff PLC

(57) ABSTRACT

A cooling device comprises a cooling tube containing a working gas, a pressure oscillator connected to a first end of the cooling tube to generate a pressure oscillation and displacement of the working gas, and means for phase shifting the pressure oscillation relative to displacement of the working gas, connected to a second end of the cooling tube. The device further comprises a first sealed pressure transmission element to separate the working gas from a fluid contained in the phase shifting means. The fluid and the working gas are of different natures.

12 Claims, 4 Drawing Sheets

(56) References Cited

U.S. PATENT DOCUMENTS

| | | | | |
|---|---|---|---|---|
| 6,209,328 | B1 * | 4/2001 | Kim | F04B 35/045 310/13 |
| 2002/0166325 | A1 * | 11/2002 | Corey | F02G 1/0435 62/6 |
| 2010/0293968 | A1 * | 11/2010 | Garaway et al. | 62/51.2 |

FOREIGN PATENT DOCUMENTS

| | | | | |
|---|---|---|---|---|
| GB | 2104155 A | * | 3/1983 | F02G 1/0435 |
| JP | H0914775 | * | 1/1997 | |

OTHER PUBLICATIONS

Yanai, JPH0914775TRANS (English Translation), Jan. 1997.*
Swift, Use of inertance in orifice pulse tube refrigerators, 1997, Cryogenics.*
Hu et al., "An innovative configuration for thermoacoustically-driven pulse tube coolers," *Cryogenics*, 2005, pp. 523-527, vol. 45, Elsevier Ltd.
International Search Report issued in International Application No. PCT/FR2011/000205 dated Aug. 9, 2011 (with translation).

* cited by examiner

PASSIVE PHASE CHANGE COOLING DEVICE

BACKGROUND OF THE INVENTION

The invention relates to a cooling device comprising a cooling tube and a pressure oscillator connected to a first end of the cooling tube to generate a pressure oscillation and displacement of a working gas contained in the cooling tube. The device also comprises means for shifting the phase of the pressure oscillation with respect to displacement of the working gas connected to a second end of the cooling tube.

STATE OF THE ART

FIG. 1 schematically represents a conventional cryogenics device of Stirling type. Device 1 comprises a tube 2 containing a compressible gas 3. The device also comprises a piston 4 at one end of the tube and heat exchangers 5*a* and 5*b* through which the gas flows. Heat exchanger 5*a* is placed near to piston 4 whereas heat exchanger 5*b* is arranged at the other end of tube 2. A mobile thermal regenerator 6 is located between heat exchangers 5*a* and 5*b*.

FIG. 2 schematically represents operating steps of the cooling device of FIG. 1. The gas undergoes pressure variations in alternate manner. These pressure variations are coupled with displacements of the regenerator in the tube. Operation can be broken down into four phases (A-D) based on the continuous Stirling cycle.

At the beginning of the cycle, regenerator 6 is positioned close to heat exchanger 5*b* leaving a space, occupied by gas 3, close to heat exchanger 5*a*.

In a first compression phase A, piston 4 is moved towards heat exchanger 5*a* to compress gas 3. The gas heats and a part of the heat is transferred to heat exchanger 5*a*.

In transfer phase B, regenerator 6 is moved towards heat exchanger 5*a*. A quantity of gas 3 passes through regenerator 6 being cooled to occupy a volume situated this time close to heat exchanger 5*b*.

In expansion phase C, piston 4 moves away from heat exchanger 5*a*. Gas 3 expands and cools further. The gas thus produces the cooling effect.

In a last transfer phase D, regenerator 6 reverts to its initial position close to heat exchanger 5*b*. A quantity of gas 3 again passes through regenerator 6 while it warms up.

Piston 4 thus acts as a source of pressure oscillations whereas regenerator 6 acts as a thermal sponge removing or supplying heat energy to the gas flowing through it. It also acts as heat insulator between the hot side of tube 2, at the level of heat exchanger 5*a*, and the cold side of the tube, at the level of heat exchanger 5*b*.

The efficiency of cryogenic devices operating according to this principle depends in particular on the phase shift between the movement of the regenerator and the pressure wave of the gas. In the case of the device represented in FIG. 1, this phase shift is ensure mechanically by the displacement of regenerator 6, which is approximately in phase quadrature with respect to the movement of piston 4.

The device of FIG. 1 presents a good efficiency but a complex architecture, in particular because of the presence of a cold mobile part constituted by regenerator 6. Due to this complexity and to the vibrations induced by the mobile regenerator, the Stirling cooling device cannot be used in certain spatial or aeronautic applications.

FIG. 3 represents a cooling device having a reduced number of moving parts. This type of device is commonly called pulsed gas tube or pulse tube. The phase shift between the displacement wave and the gas pressure wave is achieved in passive manner by means of an inertance tube and a gas reservoir. The regenerator is fixed.

This cooling device generally comprises a pressure oscillator 7 enabling the working gas to be compressed and moved in tube 2. Tube 2, represented in a U shape in FIG. 3, comprises a part formed by regenerator 6 and a part formed by an expansion tube 8. A heat exchanger 5*b* is placed between regenerator 6 and expansion tube 8 to form the interface with the environment to be cooled.

Oscillator 7 is connected to one end of tube 2 on regenerator 6 side whereas a phase shift system 9 is connected to the other end of tube 2, on the expansion tube 8 side. Phase shift system 9 enables the variations of flowrate and pressure of the working gas to be adjusted and conventionally comprises an inertance tube 10 and a gas reservoir 11. Heat exchangers 5*a* and 5*c* are placed at the hot ends of tube 2, respectively interfaces with pressure oscillator 7 and with phase shift system 9.

The assembly comprising regenerator 6, expansion tube 8 and phase shift system 9 can be called the "cold finger" of the cooler.

The operating cycle of such a device is close to the Stirling cycle described in relation with FIG. 2. The pulse tube differs from the device of FIG. 1 by the immobility of regenerator 6 and therefore the absence of moving parts in the cold part, thereby reducing the vibrations. The reliability of the device is then increased and integration is facilitated. Instead of a mobile regenerator, a passive component formed by expansion tube 8 and phase shift system 9 is used. A part of the gas present in expansion tube 8 acts as a virtual piston which transmits the work of the cold area (heat exchanger 5*b*) to phase shift system 9. Expansion tube 8 thermally insulates "cold" heat exchanger 5*b* from "hot" heat exchanger 5*c*.

Phase shift system 9 communicates with expansion tube 8 and offers a resistance to movement of the working gas. It creates the required phase shift between the pressure oscillation and the gas flow on inlet to inertance tube 10. The inertance tube is sometimes called "capillary tube" for its geometric characteristics, preferably thin and elongate. The phase shift obtained varies according to the pressure losses, on inlet and along tube 10, and to the physical parameters of the gas used. It also depends on the frequency, the mean pressure and the pressure oscillation on inlet to tube 10, on the heat exchanger 5*c* side.

FIG. 4 represents the phase and amplitude of the gas flow on inlet to the inertance tube for a given pressure wave and for different geometries of the inertance tube. The diameter of the tube varies from 1 to 3 mm and its length is comprised between 500 and 3000 mm. It can be observed that the area of low flow rates and high phases, represented in a broken line, is inaccessible whatever the geometry of the inertance tube used. It is thus not possible to adjust the geometric parameters to improve the phase shift and flowrate amplitude performances of the inertance tube.

Numerous improvements to the passive phase shift system of FIG. 3 have been envisaged. These solutions nevertheless remain complex and difficult to implement. Furthermore, they do not always enable an optimal phase shift value to be obtained.

OBJECT OF THE INVENTION

The object of the invention is to provide a cooling device that is compact and simple to produce and that has good cooling performances.

More particularly, the object of the invention is to provide a cooling device enabling an optimal phase shift to be obtained in passive manner.

According to the invention, these objectives tend to be achieved by the fact that the device comprises a first sealed pressure transmission element arranged to separate the working gas from a fluid contained in the phase shift means, the fluid being of different nature from that of the working gas.

BRIEF DESCRIPTION OF THE DRAWINGS

Other advantages and features will become more clearly apparent from the following description of particular embodiments of the invention given for non-restrictive example purposes only and illustrated by means of the appended drawings, in which.

DESCRIPTION OF A PREFERRED EMBODIMENT OF THE INVENTION

Figure 5:
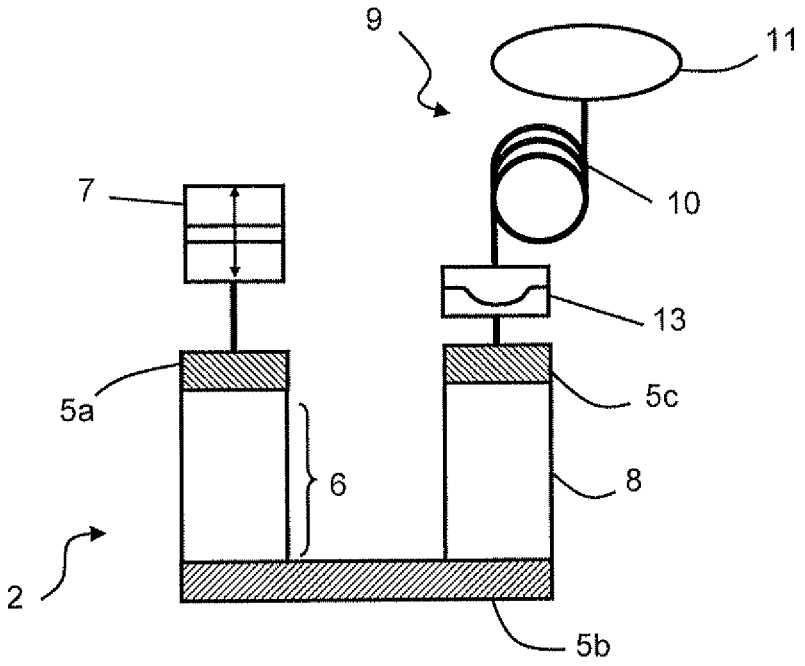

FIG. 5 represents a cooling device, of pulse tube type, having a compact and optimized phase shift system.

Figure 1:
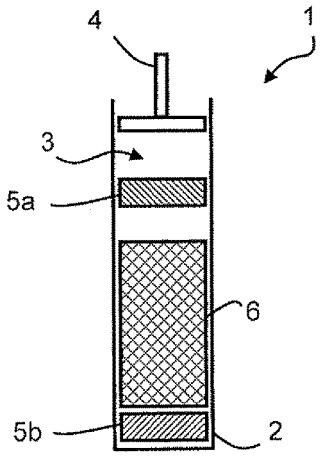
Fig. 1 (prior art)
FIG. 1 schematically represents a cooling device of Stirling type according to the prior art.
Figure 2:
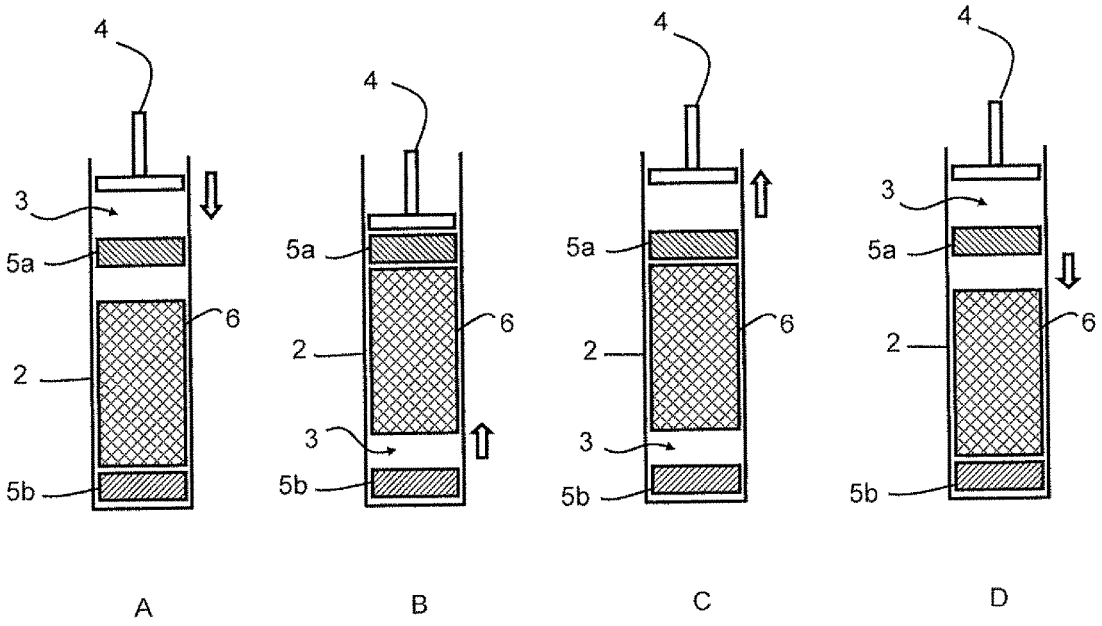
Fig. 2 (prior art)
FIG. 2 represents steps of an operating cycle of the device of FIG. 1, FIG. 3 schematically represents a cooling device with passive phase shift according to the prior art.
Figure 3:
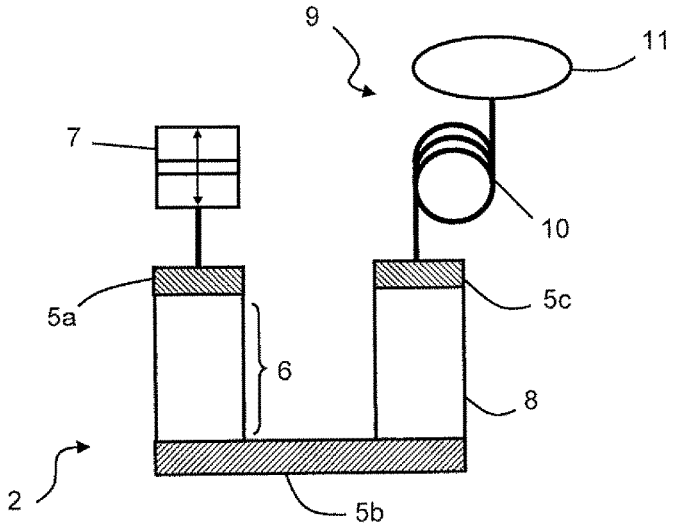
Fig. 3 (prior art)

This device comprises, like the pulse tube of FIG. 3, a cooling tube 2 containing a working gas and a pressure oscillator 7 connected to a first end of tube 2. The working gas is preferably chosen from helium, neon, argon, nitrogen and carbon dioxide. Helium is particularly used as it enables very low temperatures to be reached, between about 4 K and 80 K. Pressure oscillator 7 generates a pressure wave, preferably sinusoidal, to compress and move the working gas in tube 2. A phase shift system 9 between the pressure oscillation and displacement of the gas is connected to a second end of tube 2.

The cooling tube preferably comprises a regenerator 6, on the same side as the first end, and an expansion tube 8, on the same side as the second end. Heat exchangers 5*a* and 5*c* are respectively arranged at the first and second ends of tube 2 and define the hot parts of tube 2. These parts are generally at ambient temperature, as well as phase shift system 9 and pressure oscillator 7. A heat exchanger 5*b* is arranged in tube 2 between regenerator 6 and expansion tube 8. It forms the cold area of the device intended to be placed in contact with a system to be cooled, for example an infrared detector.

Phase shift system 9 comprises an inertance tube 10 connecting the second end of cooling tube 2 to a gas reservoir 11. The inertance tube preferably has a diameter comprised between 0.5 mm and 5 mm and a length comprised between 500 mm and 5000 mm.

Figure 4:
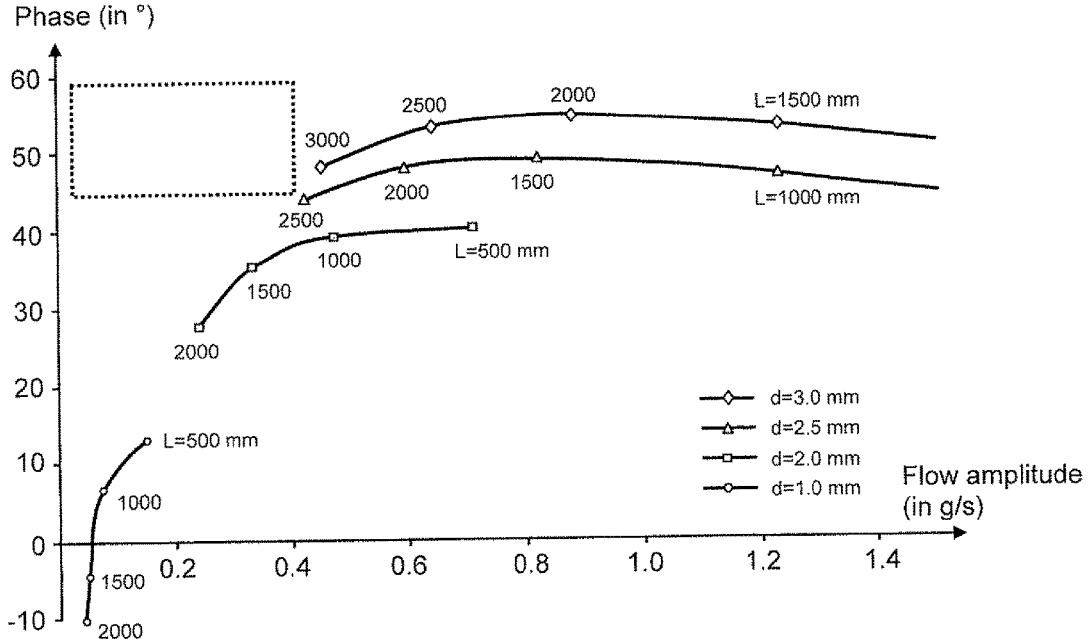
Fig. 4 (prior art)
FIG. 4 represents the phase and amplitude of the gas flow of a device according to FIG. 3, for different geometries of the phase shift system, FIGS. 5 and 6 schematically represent two particular embodiments of a cooling device comprising a separation element.

As described in the foregoing in relation with FIG. 4, a particular geometry of the inertance tube does not enable a high phase shift value and a low flowrate amplitude to be obtained. This limitation is due on the one hand to the storage effects in the inertance tube and on the other hand to the properties of the fluid used for the phase shift. The phase shift can thus be improved by modifying properties of the fluid, in particular the density over viscosity ratio.

The device of FIG. 5 proposes to extend the phase shift and flowrate amplitude possibilities (FIG. 4) of inertance tube 10 by using a phase-shift fluid different from the working gas. The fluid used for the phase shift is separated from working gas by a sealed pressure transmission element 13.

Pressure transmission element 13 also enables transfer of the compression and expansion work of the working gas to the phase-shift fluid. This involves a passive component which induces few vibrations, preferably a membrane which is deformable by the action of the gas.

Membrane 13 is preferably made from metal or polymer. A polymer membrane provides a greater elasticity. The deformations tolerated by a membrane made from polymer, which define the volume swept by the membrane in operation, will be greater than in the case of a metal membrane for a given diameter. The polymer membrane will therefore be more compact than a metal membrane for a given swept volume. An elastomer membrane with a diameter of 40 mm and a thickness of 1 mm typically enables a deformation (sag) of 4.5 mm for a swept volume of 3.8 $cm^3$. A metal membrane, made from aluminium for example, with a diameter of 60 mm and a thickness of 0.1 mm, will have a movement of about 2 mm for a swept volume of 3.8 $cm^3$. The metal membrane will have a better durability whereas the elastomer membrane will be easier to implement.

The phase shift can be improved by increasing the ratio of the density over the viscosity of the fluid. The phase-shift fluid thus has a higher density than that of the working gas or a lower viscosity than that of the working gas or the two combined. The ratio of the density over the viscosity of the fluid is preferably more than twice that of the working gas and less than 15 times that of the working gas. The phase-shift fluid is preferably chosen from nitrogen, argon, neon and air. For example, for nitrogen, air or argon, the ratio of the density over the viscosity is about 10 times higher than that of helium. For neon, the ratio is about 3.6 times higher than that of helium.

For better performances of membrane 13, it is desirable for the latter to have a centred mean position. In operation, membrane 13 thus oscillates around its central position to maximize the swept volume. The operating range is thus maximized. The device preferably comprises means for adjusting the mean position of membrane 13, by balancing the mean pressures each side of the membrane.

Figure 6:
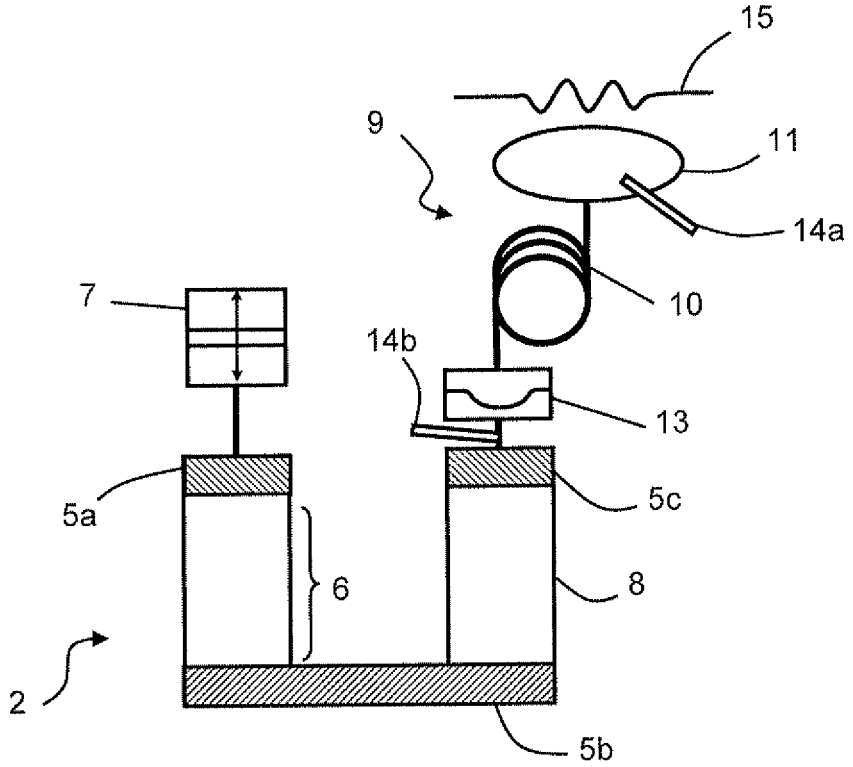

FIG. 6 represents an example embodiment of adjustment means. A first pressure sensor 14*a* is placed next to membrane 13, for example in reservoir 11 separated from the membrane by inertance tube 10. A second sensor 14*b* is placed on the other side of membrane 13 in cooling tube 2, between heat exchanger 5*c* and membrane 13 for example. Finally, the means for adjusting the mean position of membrane 13 comprise a device 15 for heating reservoir 11. The gas reservoir is heated according to the difference of mean pressures on each side of membrane 13, i.e. between reservoir 11 and cooling tube 2. In this way, the mean pressure in the phase shift system varies to maintain membrane 13 around a centred position. Filling of reservoir is performed in such a manner that the reservoir is at a lower pressure than the nominal pressure in the absence of heating.

In an alternative embodiment that is not represented, pressure sensors 14*a* and 14*b* are replaced by a movement sensor of the membrane, for example a sensor of inductive, capacitive, laser or stress gauge type. Such a sensor is connected to heating device 15.

Figure 7:
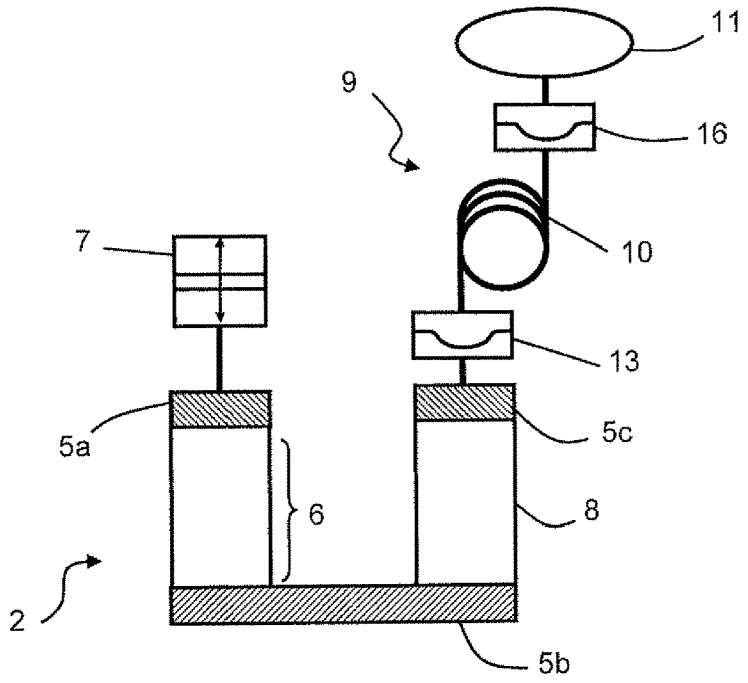
FIGS. 7 and 8 represent two embodiments of a cooling device comprising two separation elements.

FIG. 7 represents a preferred embodiment of a cooling device. In addition to the elements of the device of FIG. 5, the device comprises a second sealed pressure transmission element 16, or membrane, between inertance tube 10 and reservoir 11. Tube 10 can then be filled with a different phase-shift fluid separate from the gas contained in reservoir 11. The phase-shift fluid is preferably incompressible. A liquid can be used for the phase shift in tube 10, whereas the reservoir is filled with a compressible gas, preferably identical to the working gas.

The use of a liquid in inertance tube 10 increases the phase shift possibilities even further. Indeed, due to the incompressible nature of the liquids, the storage phenomena in tube 10 are eliminated. A liquid further has a high density and enables a simpler application.

The device further comprises a device for balancing the mean pressures of the gases that are exerted on membranes 13 and 16, i.e. the mean pressures of reservoir 11 and cooling tube 2. Due to this balancing, the liquid comprised between membranes 13 and 16 is in a central position when the device is switched off and in the centred mean position when it is in operation.

Figure 8:
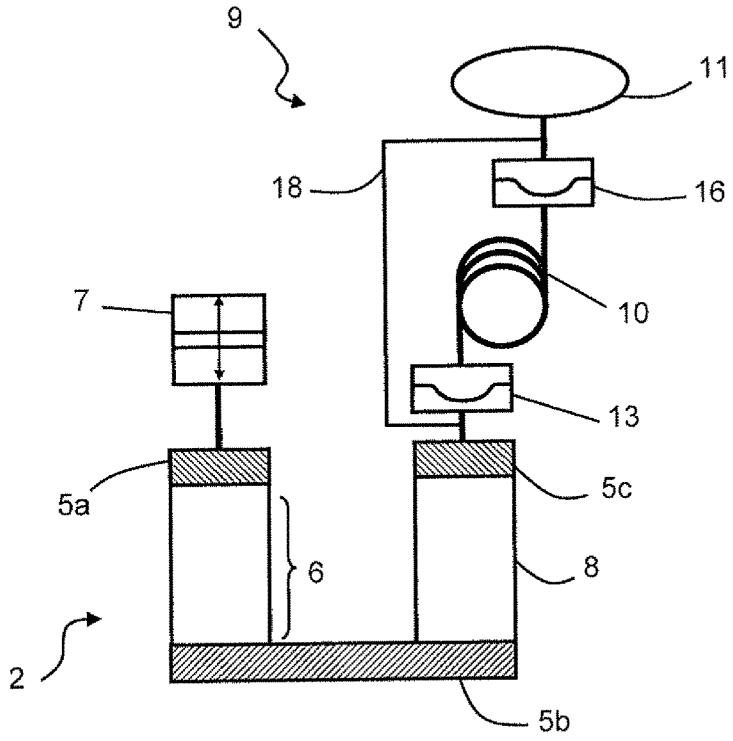

FIG. 8 represents an example embodiment of this balancing device. The device comprises a connecting tube 18 which connects the end of tube 2 on the expansion tube 8 side to reservoir 11. The two gas volumes are then connected and the mean pressures equalize out. Connecting tube 18 has a high pressure drop so that the alternate flowrate in this tube 18 is negligible (two orders of magnitude) compared with the alternate flowrate of inertance tube 10. Operation of the cooling device is then not impaired.

A balancing device comprising pressure sensors and a heating device, such as the one described in relation with FIG. 6, is also possible in the case of two membranes.

Let us consider for example purposes a pulse tube operating at a mean pressure of 20 bars and at a hot-side temperature of 300 K. The pressure oscillation, in conventional manner, has an amplitude of 1 bar and a frequency of 50 Hz.

An inertance tube filled with conventional working gas measures for example 2 mm in diameter and 2000 mm in length. The inertance tube then offers a flowrate of 0.25 g/s and a phase shift (or phase) of 25°.

By means of the membrane separating the working gas (helium) from the phase shift gas (nitrogen), as represented in FIG. 5, the inertance tube enables an identical flowrate to be obtained with a higher phase shift, of about 60°. The inertance tube then has a diameter of about 1 mm and a length of about 1700 mm.

By means of two membranes and water as phase-shift fluid, it is possible to obtain a similar flow rate of 0.2 g/s, with an even higher phase shift, of about 75°. The dimensions of the inertance tube are then a diameter of 2.0 mm and a length of about 1600 mm.

The phase shift between the pressure and the displacement of the working gas is optimized by the choice of a phase-shift fluid associated with a geometry of the inertance tube.

An adjustable valve can be used to experimentally adjust the pressure losses and therefore the phase shift and flowrate amplitude. It can in the long run be replaced by a calibrated opening. It can be placed between the first membrane and the pulse tube or between the second membrane and the buffer volume formed by the reservoir. Such a circuit will also perform energy dissipation at the second end of the cooling tube.

Numerous variants and modifications of the cooling device described here will be apparent to the person skilled in the art. In particular, it can comprise an additional asymmetric re-circulation circuit to adjust the flowrate at the hot end of the pulse tube. This circuit preferably connects the first end of the cooling tube, on the pressure oscillator side, to the second end of the tube before the first membrane. This circuit can be formed by a check valve associated with a pressure drop, for example a needle valve, and opening or again another capillary tube.

The invention claimed is:

1. A cooling device comprising:

a pressure oscillator configured to generate a pressure wave;

a working gas;

a cooling tube containing the working gas, the cooling tube having a first end connected to the pressure oscillator so that the pressure wave compresses and moves the working gas in the cooling tube from the first end to a second end;

a phase shifter configured to shift pressure oscillation of the working gas relative to displacement of the working gas, the phase shifter being connected to the second end of the cooling tube, the phase shifter comprising an inertance tube connecting the second end of the cooling tube to a reservoir, the phase shifter being separated from the pressure oscillator by the cooling tube; and a first sealed pressure transmission element spaced from the cooling tube and arranged to separate the second end of the cooling tube from the phase shifter and to separate the working gas from a fluid contained in the phase shifter, the first sealed pressure transmission element being configured to transfer compression and expansion works of the working gas to the fluid, the fluid being separated from the pressure oscillator by the working gas, wherein the fluid has a first chemical composition different from a second chemical composition of the working gas and wherein the fluid has a higher density over viscosity ratio than that of the working gas at a same temperature and pressure.

2. The device according to claim 1, wherein the density over viscosity ratio of the fluid is more than twice that of the working gas.

3. The device according to claim 1, comprising a device for adjusting the mean position of the first pressure transmission element.

4. The device according to claim 3, wherein the device for adjusting the mean position of the first pressure transmission element comprises:

a first pressure sensor in the reservoir, a second pressure sensor in the cooling tube, and a heater configured to heat the reservoir according to the pressure difference between the reservoir and the cooling tube.

5. The device according to claim 1, wherein the fluid is a gas selected from the group consisting of nitrogen, argon, neon, carbon dioxide and air.

6. The device according to claim 1, comprising a second sealed pressure transmission element between the inertance tube and the reservoir, arranged to separate the fluid from a compressible gas contained in the reservoir.

7. The device according to claim 6, wherein the fluid is a liquid.

8. The device according to claim 6, comprising a device for balancing the mean pressures of the reservoir and of the cooling tube.

9. The device according to claim 8, wherein the device for balancing the mean pressures comprises a tube connecting the second end of the cooling tube to the reservoir.

10. A cooling device comprising:

a cooling tube;

a working gas contained in the cooling tube;

a pressure oscillator connected to a first end of the cooling tube to generate a pressure oscillation and displacement of the working gas;

a phase shifter that shifts the pressure oscillation relative to displacement of the working gas, the phase shifter being connected to a second end of the cooling tube, the phase shifter comprising an inertance tube connecting the second end of the cooling tube to a reservoir;

the tube comprising a fluid contained in the phase shifter, the fluid having a higher density over viscosity ratio than that of the working gas at a same temperature and pressure, the fluid having a first chemical composition and the working gas having a second chemical composition different from the first chemical composition; and a first sealed pressure transmission element spaced from the cooling tube and arranged to separate the cooling tube from the phase shifter and to separate the working gas from the fluid.

11. The device according to claim 10, wherein the density over viscosity ratio of the fluid is more than twice that of the working gas.

12. The device according to claim 10, wherein the fluid is a gas chosen from nitrogen, argon, neon, carbon dioxide and air.

* * * * *